United States Patent [19]

Maruyama et al.

[11] 4,255,686

[45] Mar. 10, 1981

[54] STORAGE TYPE PHOTOSENSOR CONTAINING SILICON AND HYDROGEN

[75] Inventors: Eiichi Maruyama, Kodaira; Yoshinori Imamura, Hachioji; Saburo Ataka, Hinodamachi; Kiyohisa Inao, Mobara; Yukio Takasaki, Hachioji; Toshihisa Tsukada, TokySekimachi; Tadaaki Hirai, Koganei, all of Japan

[73] Assignee: Hitachi, Ltd., Japan

[21] Appl. No.: 39,580

[22] Filed: May 16, 1979

[30] Foreign Application Priority Data

May 19, 1978 [JP] Japan ..... 53-58934

[51] Int. Cl.[3] ..... H01J 29/45; H01J 31/38

[52] U.S. Cl. ..... 313/366; 313/386; 313/392

[58] Field of Search ..... 313/385, 392, 391, 366, 313/386

[56] References Cited

U.S. PATENT DOCUMENTS

| | | | |
|---|---|---|---|
| 3,890,523 | 6/1975 | Poirier | 313/366 |
| 3,982,149 | 9/1976 | Dieleman et al. | 313/366 |
| 4,147,667 | 4/1979 | Chevallier et al. | 252/501 |

FOREIGN PATENT DOCUMENTS

| | | |
|---|---|---|
| 3237 | 8/1979 | European Pat. Off. . |
| 2331887 | 6/1977 | France . |
| 1289651 | 9/1970 | United Kingdom . |
| 1349351 | 4/1974 | United Kingdom . |

*Primary Examiner*—Palmer C. Demeo

*Attorney, Agent, or Firm*—Craig & Antonelli

[57] ABSTRACT

In a photosensor having at least a light-transmitting conductive layer which is arranged on the side of light incidence, and a photoconductive layer in which charges are stored in correspondence with the light incidence; a photosensor characterized in that at least a region of said photoconductive layer for storing the charges is made of an amorphous material which contains hydrogen and silicon as indispensable constituent elements thereof, in which the silicon amounts to at least 50 atomic % and the hydrogen amounts to at least 10 atomic % and at most 50 atomic %, and whose resistivity is not lower than $10^{10}$ Ω·cm.

9 Claims, 13 Drawing Figures

STORAGE TYPE PHOTOSENSOR CONTAINING SILICON AND HYDROGEN

BACKGROUND OF THE INVENTION

1. FIELD OF THE INVENTION

This invention relates to the structure of a light-receiving face which can be employed for photosensors that are operated in the storage mode, more concretely, for a photoconductive target of an image tube, a solid-state imager, etc.

2. DESCRIPTION OF THE PRIOR ART

As a typical example of the photosensor which has heretofore been used in the storage mode, there is a photoconductive type image tube shown in FIG. 1. It is made up of a light-transmitting substrate 1 which is usually called the "face plate", a transparent conductive layer 2, a photoconductive layer 3, an electron gun 4, and an envelope 5. An optical image formed on the photoconductive layer 3 through the face plate 1 is photoelectrically converted, and is stored as a charge pattern in the surface of the photoconductive layer 3. The charge pattern is read in time sequence by a scanning electron beam 6.

At this time, an important property required for the photoconductive layer 3 is that the charge pattern does not decay due to diffusion within a time interval in which a specified picture element is scanned by the scanning electron beam 6 (that is, a storage time). Accordingly, semiconductors whose resistivities are not lower than $10^{10}$ Ω·cm, for example, chalcogenide glasses containing $Sb_2S_3$, PbO and Se are ordinarily employed as the materials of the photoconductive layer 3. In case where a material such as Si single crystal whose resistivity is lower than $10^{10}$ Ω·cm is employed, the surface of the layer 3 on the electron beam scanning side needs to be divided in a mosaic fashion so as to prevent the decay of the charge pattern. Among these materials, the Si single crystal is complicated in the working process. The high-resistance semiconductors usually contain high densities of trap levels hampering the traveling of photo carriers. Therefore, they are inferior in the photo response and are liable to cause the drawback that a long decay lag and an after-image develop as the imaging device.

This invention intends to eliminate the above disadvantages.

SUMMARY OF THE INVENTION

This invention consists in a photosensor having at least a light-transmitting conductive layer which is arranged on the side of light incidence, and a photoconductive layer in which charges are stored in correspondence with the light incidence, characterized in that said photoconductive layer is constructed of a single layer or a plurality of layers of a photoconductive substance, and that at least a region of said photoconductive layer for storing said charges is made of an amorphous material which contains hydrogen and silicon as indispensable constituent elements thereof, in which the silicon amounts to at least 50 atomic % and the hydrogen amounts to at least 10 atomic % and at most 50 atomic %, and whose resistivity is not lower than $10^{10}$ Ω·cm.

DETAILED DESCRIPTION OF THE PREFERRED EMBODIMENTS

An object of this invention is to provide a photosensor employing the storage mode as has a high resolution. The photosensor according to this invention undergoes a very feeble after-image, and is favorable in the decay lag characteristic. Besides, the manufacturing method of the photosensor is simple.

The photosensor of this invention consists basically in a photosensor having at least a light-transmitting conductive layer which is arranged on the side of light incidence, and a photoconductive layer in which charges are stored in correspondence with the light incidence, characterized in that said photoconductive layer is constructed of a single layer or a plurality of layers of a photoconductive substance, and that at least a region of said photoconductive layer for storing said charges is made of an amorphous material which contains hydrogen and silicon as indispensable constituent elements thereof, in which the silicon amounts to at least 50 atomic % and the hydrogen amounts to at least 10 atomic % and at most 50 atomic %, and whose resistivity is not lower than $10^{10}$ Ω·cm.

The thickness of the photoconductive layer is selected from a range of 100 nm to 20 μm.

Means for deriving the charges stored in the photoconductive layer by the incidence of light, as an electric signal from the photoconductive layer is as stated below. A typical example is a method in which the photoconductive layer is scanned with an electron beam, and this is extensively employed in image tubes etc. Another example is a method which is employed in a solid-state image sensor and in which the stored charges are taken out by a semiconductor device such as MOS transistor and CCD (charge coupled device) connected to the photoconductive layer.

Figure 2:
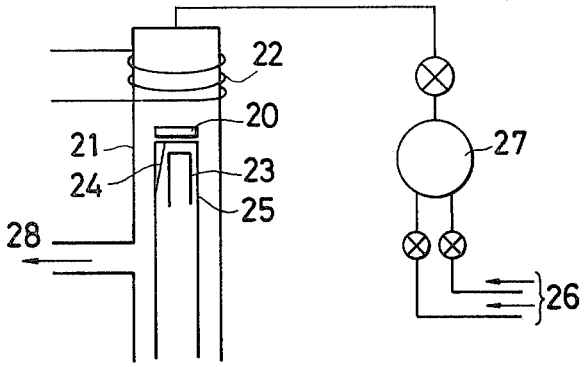
FIGS. 2 and 3 are explanatory views each showing an example of equipment for fabricating a thin film.
Figure 3:
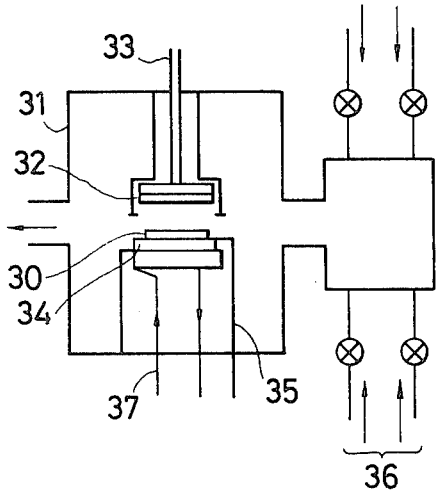

It has been found out that the amorphous material containing both silicon and hydrogen is a photoconductive material of good quality which can be readily put into a high resistivity of or above $10^{10}$ Ω·cm and which has a very small number of traps impeding the traveling of photo carriers. Here, there can naturally be a case where some impurities are included in the amorphous material containing both silicon and hydrogen. Some oxygen is easily included in said amorphous material as a impurity. In some cases, germanium which is an element of the same family as that of silicon is contained as the balance of the aforecited composition. The germanium amounts to at most 40 atomic %. This material is used in the shape of a thin film. A thin-film sample can be formed by various methods such as the decomposition of $SiH_4$ by the glow discharge, the sputtering of a silicon alloy in an atmosphere containing hydrogen, and the electron beam evaporation of a silicon alloy in an atmosphere containing active hydrogen. FIGS. 2 and 3 show explanatory views of examples of typical equipment for forming the thin-film sample. In the example of FIG. 2, the glow discharge is employed. Numeral 20 designates a sample, numeral 21 a vessel which can be evacuated into a vacuum, numeral 22 a radio-frequency coil, numeral 23 a sample holder, numeral 24 a thermocouple for measuring temperatures, numeral 25 a heater, numeral 26 introducing ports for atmosphere gases of $SiH_4$ etc., numeral 27 a tank for mixing the gases, and numeral 28 a connection port to an evacuating system. The example of FIG. 3 is based on the sputtering process. Numeral 30 indicates a sample, numeral 31 a vessel which can be evacuated into a vacuum, and numeral 32 a target for sputtering as which a sintered compact of silicon or the like is used. Numeral 33 denotes an electrode to which a radio-frequency voltage is applied, numeral 34 a sample holder, numeral 35 a thermocouple for measuring temperatures, numeral 36 introducing ports for gases of a rare gas such as argon, hydrogen, etc., and numeral 37 a passage for coolant water.

A manufacturing method which is especially favorable for obtaining the high-resistance sample is a method which resorts to the reactive sputtering of a silicon alloy in a mixture atmosphere consisting of hydrogen and a rare gas such as argon. With the amorphous film fabricated by the use of the glow discharge, it is very difficult to attain the resistivity of or above $10^{10}$ Ω·cm. In contrast, the amorphous film produced by the use of the reactive sputtering can easily offer the resistivity which is not lower than $10^{10}$ Ω·cm. Moreover, the amorphous film relied on the reactive sputtering is superior in various imaging characteristics to the amorphous film resorted to the glow discharge. Suitable as equipment for the sputtering is low-temperature high-speed sputtering equipment employing a magnetron. Usually, the amorphous film containing hydrogen and silicon emits the hydrogen and changes in nature when heated to above 350° C. It is therefore desirable that the substrate temperature during the formation of the film is held at 100° C.—300° C. The concentration of hydrogen contained in the amorphous film can be greatly varied in such a way that the partial pressure of hydrogen in the pressure $2\times10^{-3}$ Torr–$1\times10^{-1}$ Torr of the atmosphere under discharge is changed variously from 0% to 100%. As the target for sputtering, the sintered compact of silicon is employed. If necessary, it is doped with boron being a p-type impurity or with phosphorus being an n-type impurity. Of course, As, Sb, Bi, Ga, In, or the like can be employed as a doping impurity. The amount of the impurity usually fall swithin the range of $10^{-5}$ at % to 1 at %. This range is generally employed in a field of a semiconductor technique. Further, it is possible to employ a mixed sintered compact consisting of silicon and germanium. Regarding the amorphous films thus prepared, the resistivity which is particularly suitable for the photosensor to be operated in the storage mode is at least $10^{10}$ Ω·cm. (For image tubes, the resistivity should more preferably be at least $10^{12}$ Ω·cm.) In actuality, a resistivity of $10^{16}$ Ω·cm will be the limitation, though the design of the photosensor is also a determinant. Especially favorable for obtaining the film of a low trap density is a case where the hydrogen content of the film amounts to 10–50 atomic % and where the silicon content amounts to at least 50 atomic %. When the hydrogen content is too little, the resistance value lowers excessively. Therefore, the degradation of the resolution is incurred. When the hydrogen content is too much, the photoconductivity lowers, and the photoconductive characteristic becomes unsatisfactory. Naturally, the resolution is degraded.

In the photosensor which is operated in the storage mode, the high-resistance layer which stores the charge pattern and retains it for a fixed time in order to obtain a high resolving power need not always be the whole photoconductive layer, but it may well be a part of the photoconductive layer including a surface on which the charge pattern appears. Ordinarily, the high-resistance layer operates as a capacitive component in an equivalent circuit. On account of a request from a circuit constant, therefore, it is desired to be at least 100 nm thick.

Figure 4:
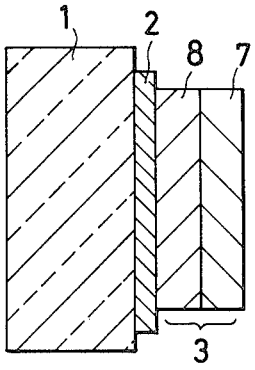
FIGS. 4 to 10 are sectional views each showing an image tube target which utilizes a photosensor of this invention.

FIG. 4 shows an example in the case where the high-resistance amorphous photoconductive layer is used in only a part of the photoconductive layer 3. The photoconductive layer 3 has a two-layered structure consisting of a high-resistance amorphous photoconductive layer 7 and an another photoconductive layer 8. In this case, photo carriers are generated in the photoconductive layer 8 by light having entered in the direction of the face plate 1, they are injected into the high-resistance amorphous photoconductive layer 7, and they are stored in the surface of the amorphous layer 7 as a charge pattern. Since the photoconductive layer 8 is not directly concerned with the storage, it need not always have the high resistance of at least $10^{10}$ Ω·cm, and well-known photoconductors such as CdS, CdSe, Se and ZnSe can be employed therefor.

Figure 5:
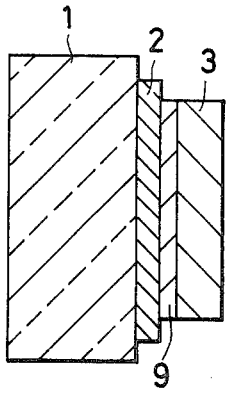
Figure 6:
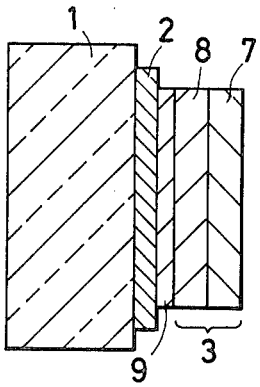

As the transparent conductive layer 2, there can be usually employed a low-resistance oxide film of $SnO_2$, $In_2O_3$, $TiO_2$ or the like or a semitransparent metal film of Al, Au or the like. In order to reduce the dark current of the photosensor and to enhance the response speed, it is desirable to form a rectifying contact between the transparent conductive layer 2 and the photoconductive layer 3. By interposing a thin n-type oxide layer between the photoconductive layer 3 and the transparent conductive layer 2, it is possible to suppress the injection of holes from the transparent conductive film 2 to the photoconductive layer 3. It has been revealed that a favorable rectifying contact is attained in this way. Herein, in using the contact as a photodiode, it is desirable to make the transparent conductive layer side a positive electrode and the amorphous layer side a negative electrode. FIG. 5 shows an example of a light-receiving face having such a structure. An n-type oxide layer 9 is interposed between the transparent conductive layer 2 and the amorphous photoconductive layer 3. Likewise, FIG. 6 is a sectional view showing an example of a light-receiving face which has the n-type oxide layer. This example is the same as the example of FIG. 5 except that the photoconductive layer 3 has a laminated structure consisting of the layers 7 and 8. Ordinarily, a photoconductor sensitive to the visible region is a semiconductor whose band gap is about 2.0 eV. In this case, accordingly, the n-type oxide layer 9 should desirably have a band gap of at least 2.0 eV so as not to impede the light from reaching the photoconductive layer 3. In order to check the injection of holes from the transparent conductive film 2, the thickness of the n-type oxide layer 9 suffices with a value of from 5 nm to 100nm or so. As materials suitable for this use, compounds such as cerium oxide, tungsten oxide, niobium oxide, germanium oxide and molybdenum oxide exhibit favorable characteristics. Since these materials ordinarily present the n-conductivity type, photoelectrons generated in the amorphous photoconductive layer 3 by the light are not prevented from flowing towards the transparent conductive layer 2.

Figure 1:
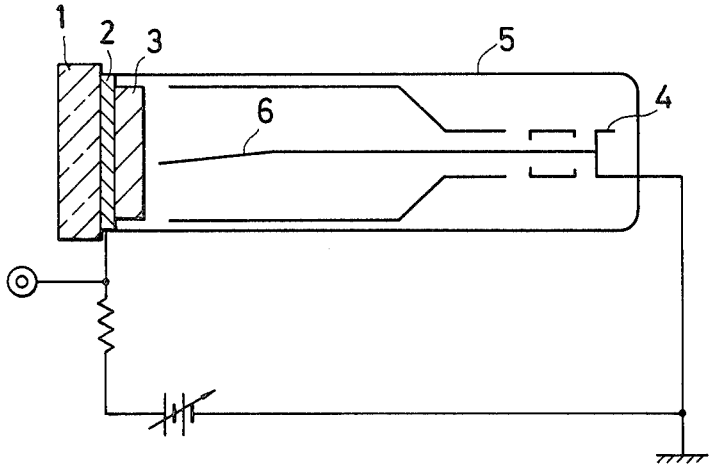
FIG. 1 PRIOR ART
FIG. 1 is a sectional view of a photoconductive type image tube which is a typical example of a storage type photosensor.
Figure 7:
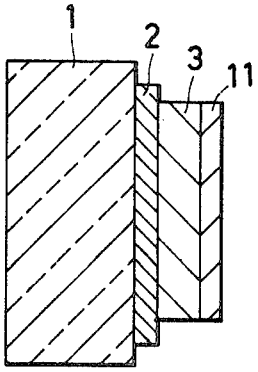
Figure 8:
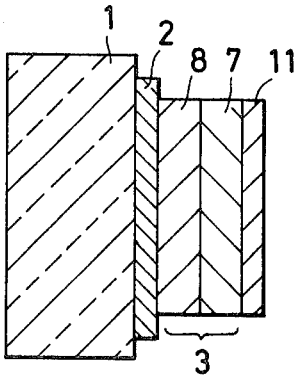
Figure 9:
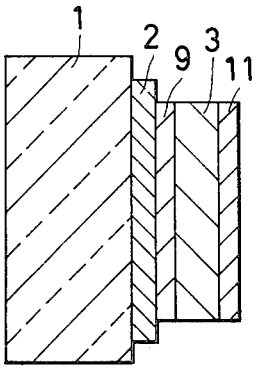
Figure 10:
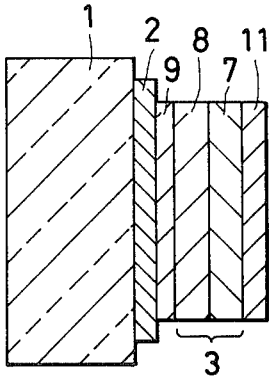

In case where the photoelectric face of this invention is employed as the target for an image tube as illustrated in FIG. 1, ordinarily an antimony-trisulfide layer is further stacked on the surface of the photoconductive layer 3 as a beam landing layer. This makes it possible to prevent the injection of electrons from the scanning electron beam 6 or to suppress the generation of secondary electrons from the photoconductive layer 3. To this end, the antimony-trisulfide film is evaporated in argon gas under a low pressure of from $1\times10^{-3}$ Torr to $1\times10^{-2}$ Torr, and its thickness suffices in a range of from 10 nm to 1 $\mu$m. FIG. 7 is a sectional view which shows an example of such a structure. On the light-transmitting substrate 1, the transparent conductive layer 2 and the photoconductive layer 3 are disposed. Further, an antimony-trisulfide film 11 is formed on the photoconductive layer 3. Also FIGS. 8 to 10 are sectional views each of which shows an example wherein the antimony-trisulfide layer 11 is formed on the photoconductive layer 3. Herein, FIG. 8 shows an example in which the photoconductive layer 3 has the laminated structure consisting of the layers 7 and 8, and FIGS. 9 and 10 show examples in which this measure is applied to the structure provided with the n-type oxide layer between the photoconductive layer 3 and the transparent electrode.

Although the photoconductive layer 3 thus far described is exemplified only as the single layer or the two layers composed of the layers 7 and 8, it may be constructed into more layers. In this case, it is a matter of course that the part in which the charge pattern is stored is constructed as the high-resistance layer as stated previously.

In addition, the composition may be continuously varied.

The constructions of the various light-receiving faces thus far explained may be selected in conformity with the particular purposes.

The features of the photosensor of this invention will be summed up below.

(1) Regarding the resolving power, a high resolution of 800 or more lines per inch can be realized.

(2) No after-image appears, and the after-image characteristic is very excellent.

(3) The photosensor is excellent in the heat resistance, and can endure at least 200° C.

(4) The mechanical strength is high.

(5) The manufacturing method is easy.

Hereunder, this invention will be described more in detail in connection with examples.

EXAMPLE 1

Figure 11:
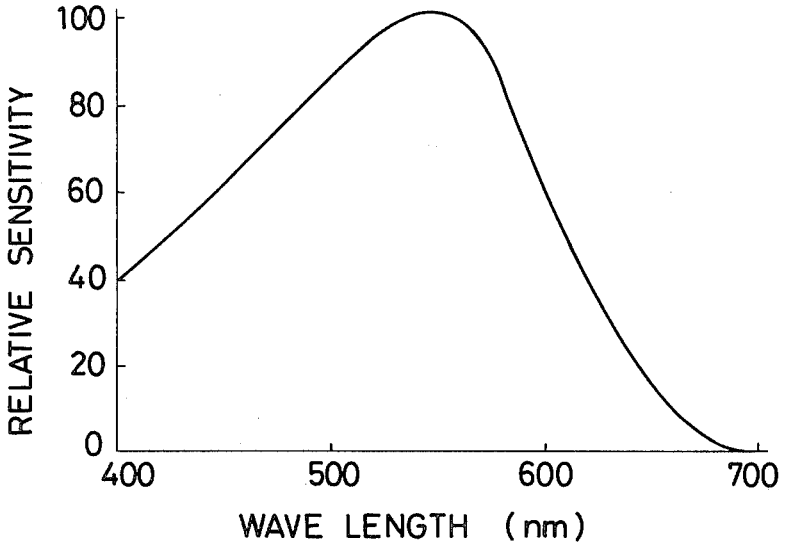
FIG. 11 is a graph showing a spectral sensitivity characteristic of the photosensor according to this invention.

On a glass substrate, a transparent conductive layer was formed to a thickness of 300 nm by employing a method based on the thermodecomposition of $SnCl_4$ in the air. Subsequently, a sintered compact of silicon at 99.999% was installed as a target in a high-frequency sputtering equipment, and the reactive sputtering of an amorphous silicon film was made on the transparent conductive film in a mixed atmosphere consisting of argon under a pressure of $5\times10^{-3}$ Torr and hydrogen under a pressure of $3\times10^{-3}$ Torr. In this case, the substrate was held at 200° C. The thickness of the amorphous silicon film was about 2 $\mu$m. The amorphous silicon film thus produced contained approximately 30 atomic % of hydrogen, and had a resistivity of $10^{14}$ $\Omega$·cm. Further, a beam landing layer was formed of antimony trisulfide. Then, a light-receiving face was completed. When the light-receiving face thus formed was employed as a light-receiving face of a vidicon type image tube, an image tube which had an excellent imaging characteristic free from any after-image was obtained. FIG. 11 shows the sensitivity characteristic of the vidicon type image tube in which the light-receiving face above described was assembled. By the way, the fundamental structure of the image tube except the light-receiving face was the same as in the prior-art construction shown in FIG. 1. The target voltage was 30 V. As seen from FIG. 11, the characteristic is extraordinarily favorable because it has a sensitivity peak in the vicinity of 555 m$\mu$ at which the peak of the visibility lies.

Figure 12:
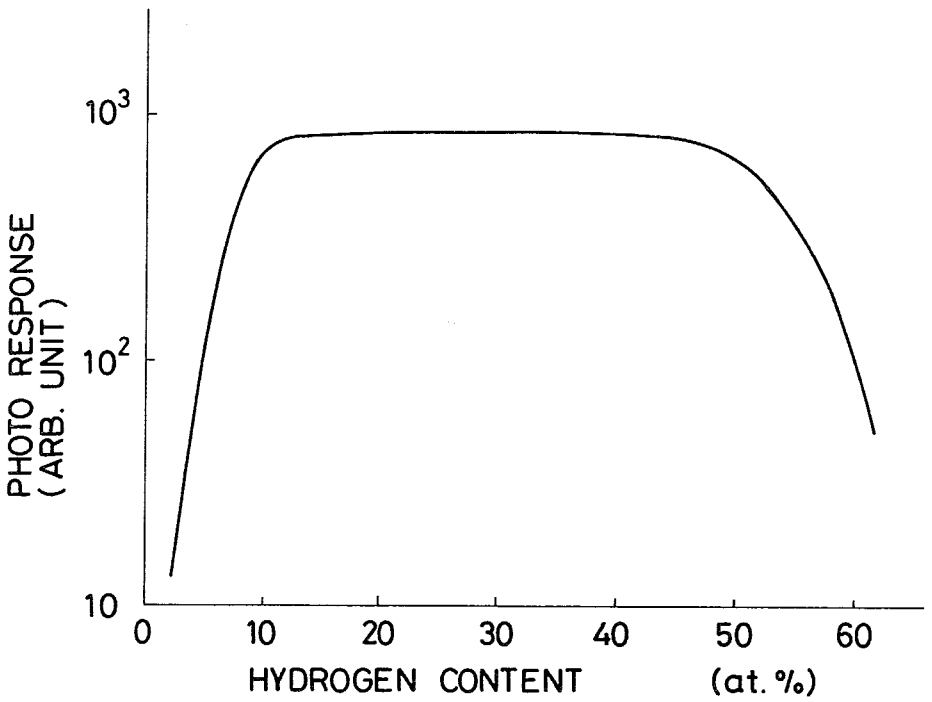
FIG. 12 is a graph showing the relationship between the hydrogen concentration of a photoconductive layer and the photo response thereof.

FIG. 12 shows a result obtained in such a way that, as to a light-receiving face having the same structure as in the above, the photo response was measured by varying the hydrogen content of the amorphous material containing hydrogen and silicon as its indispensable constituent elements. A tungsten lamp was used as a light source, and the photocurrent flowing through the light-receiving face was measured. It is understood from the photo response characteristic that the amorphous material whose hydrogen content is 10 atomic % to 50 atomic % is favorable for the object of this invention. In addition, when the hydrogen concentration is below 10 atomic %, the resistivity of the material lowers, and the high resolution of the device cannot be expected. By way of example, when the hydrogen concentration is 10 atomic % the resistivity is about $10^{12}$ $\Omega$·cm, whereas when it is 5 atomic % the resistivity becomes much lower than $10^{10}$ $\Omega$·cm.

EXAMPLE 2

On a glass substrate 1, a mixture consisting of $SnO_2$ and $In_2O_3$ was deposited by the well-known radio-frequency sputtering, and a transparent conductive layer being 150 nm thick was formed. Further, $CeO_2$ was vacuum -deposited thereon to a thickness of 20 nm by the use of a molybdenum boat, to form an n-type oxide layer 9. Subsequently, using a radio-frequency sputtering equipment whose target was a silicon single crystal doped with 1 p.p.m. of boron, an amorphous silicon film 8 was formed on the resultant substrate to a thickness of 100 nm in an atmosphere of hydrogen under $3\times10^{-3}$ Torr. At this time, the substrate temperature was held at 150° C. The amorphous silicon film thus formed contained about 55 atomic % of hydrogen therein. Argon under $6\times10^{-3}$ Torr was subsequently introduced into the sputtering equipment, and an amorphous silicon film 7 was stacked and formed to a thickness of 3 $\mu$m by the use of the silicon target in the hydrogen-argon mixture atmosphere already existing in the equipment. This amorphous silicon film was somewhat of the p-type, contained about 25 atomic % of hydrogen and had a resistivity of $10^{12}$ $\Omega$·cm. The light-receiving face thus formed was employed as a target of a vidicon type image tube. Except for the construction of the light-receiving face, the image tube had the same structure as that of the prior-art image tube. Since this light-receiving face has a rectifying contact, the photo response speed is high, and the dark current is low. Moreover, since it includes the amorphous silicon film having the high hydrogen concentration and being near to the light incident plane, the influence of the surface recombination can be lessened, and a high sensitivity is accordingly exhibited in the blue light region.

Even when tungsten oxide, niobium oxide, germanium oxide, molybdenum oxide or the like is employed for the n-type oxide layer, an equivalent effect can be achieved.

As stated previously, it is also favorable for the target of the vidicon type image tube to form an antimony-trisulfide film on the photoconductive layer 3 composed of the amorphous silicon films 8 and 7. The formation of the antimony--trisulfide film may resort to a method as stated below. A substrate having the photoconductive film which is made up of the composite film of the amorphous silicon films is set in a vacuum-deposition equipment. Using argon gas under a pressure of $3\times10^{-3}$ Torr, antimony trisulfide is evaporated and formed to a thickness of 100 nm. This corresponds to the structure illustrated in FIG. 10.

EXAMPLE 3

This example will be explained with reference to FIG. 8.

An aqueous solution of $SnCl_4$ was sprayed and oxidized on a glass substrate 1 heated to 400° C., to form an $SnO_2$ transparent conductive layer 2. While holding the resultant substrate at 200° C. in a vacuum equipment, CdSe was evaporated on the transparent conductive layer 2 to a thickness of 2 μm and as a photoconductive layer 8. Thereafter, the CdSe film was heat-treated at a temperature of 500° C. in the air for 1 hour. Further, while holding the resultant substrate at 250° C. in the vacuum equipment, an amorphous silicon layer 7 was evaporated to a thickness of 0.5 μm by the electron-beam evaporation in an atmosphere of active hydrogen under $1\times10^{-3}$ Torr. Thereafter, the substrate temperature was reverted to the normal temperature, and antimony-trisulfide film 11 was evaporated to a thickness of 50 nm in an atmosphere of argon under $5\times10^{-3}$ Torr. Thus, a vidicon type image tube target was fabricated. The photosensor formed in this way exploited photo carriers generated in the CdSe film, so that it had a high photosensitivity over the whole visible region.

EXAMPLE 4

Figure 13:
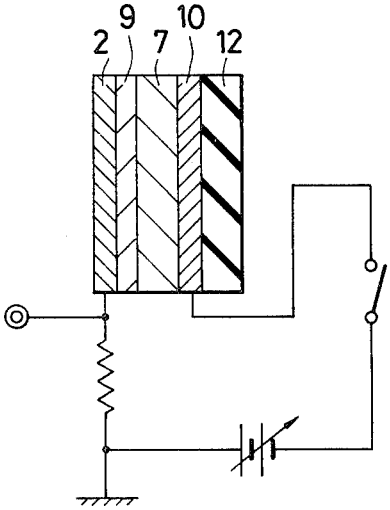
FIG. 13 is a sectional view of the principal parts of a device showing another embodiment of the photosensor of this invention.

This example will be explained with reference to FIG. 13. On an insulating smooth substrate 12, an electrode 10 was formed in such a way that metal chromium was evaporated to a thickness of 100 nm at a degree of vacuum of $1\times10^{-6}$ Torr. The resultant substrate was put in a radio-frequency sputtering equipment, and using a silicon target, an amorphous silicon film 7 being 10 μm thick was formed at a substrate temperature of 130° C. in mixed gases of argon under $5\times10^{-3}$ Torr and hydrogen under $3\times10^{-3}$ Torr. This amorphous silicon film 7 had a resistivity of $\sim10^{11}$ Ω·cm. While holding the substrate at 200° C., a film of niobium oxide 9 was deposited thereon to a thickness of 50 nm by the radio-frequency sputtering. Further, the substrate was put in a vacuum-deposition equipment, and while holding the substrate temperature at 150° C., metal indium was evaporated to a thickness of 100 nm in an atmosphere of oxygen under $1\times10^{-3}$ Torr. The resultant substrate was taken out into the atmospheric air under 1 atm., and the evaporated indium film was heat-treated at 150° C. for 1 hour. Then, the metal indium turned into a transparent electrode of indium oxide 2. The photosensor thus produced operated as a reverse-biased photodiode when a voltage was applied thereto with the indium-oxide transparent electrode being positive and the metal-chromium electrode being negative.

A photosensor to be described below was also manufactured.

On an insulating smooth substrate 12, an electrode 10 was formed in such a way that metal chromium was evaporated to a thickness of 100 nm at a degree of vacuum of $1\times10^{-6}$ Torr. The resultant substrate was put in a radio-frequency sputtering equipment, and using a target consisting of 90 atomic % of silicon and 10 atomic % of germanium, an amorphous film 7 being 10 μm thick was formed at a substrate temperature of 130° C. in mixed gases of argon under $2\times10^{-3}$ Torr and hydrogen under $2\times10^{-3}$ Torr. This amorphous film 7 had a resistivity of $2\times10^{10}$ Ω·cm. While holding the substrate at 200° C., a film of niobium oxide 9 was deposited thereon to a thickness of 50 nm by the radio-frequency sputtering. Further, the substrate was put in a vacuum-deposition equipment, and while holding the substrate temperature at 150° C., metal indium was evaporated to a thickness of 100 nm in an atmosphere of oxygen under $1\times10^{-3}$ Torr. The resultant substrate was taken out into the atmospheric air under 1 atm., and the evaporated indium film was heat-treated at 150° C. for 1 hour. Then, the metal indium turned into a transparent electrode of indium oxide 2. Thus, a photosensor was produced. It could be operated as a photodiode similarly to the foregoing. The present example is an example of the photosensor device. As compared with the foregoing cases of the image tube targets, the order of forming the multiple layers is the converse, but the structure of the light-receiving face has common parts. A linear or areal solid-state optical image sensor can be fabricated in such a way that the metallic chromium electrode on the substrate in the present example is split into a large number of segments and that the segments are connected with a circuit which sequentially reads stored charges by means of external switches. As the external switches, MOS transistors are employed. The sources of the MOS transistors are connected to the photodiodes employing the amorphous films, the drains are connected to signal output sides, and the gates have signals for readout applied thereto.

What is claimed is:

1. In a photosensor having at least a light-transmitting conductive layer which is arranged on the side of light incidence, and a photoconductive layer in which charges are stored in correspondence with the light incidence; a photosensor characterized in that said photoconductive layer is constructed of a single layer or a plurality of layers of photoconductive substances, and that at least a region of said photoconductive layer is made of an amorphous material which contains hydrogen and silicon as indispensable constituent elements thereof, in which the silicon amounts to at least 50 atomic % and the hydrogen amounts to at least 10 atomic % and at most 50 atomic %, and whose resistivity is not lower than $10^{10}$ Ω·cm.

2. A photosensor according to claim 1, characterized in that said amorphous material containing hydrogen and silicon as indispensable constituent elements thereof contains 50 atomic % of silicon and at least 10 atomic % and at most 50 atomic % of hydrogen, the balance being germanium, and that its resistivity is not lower than $10^{10}$ Ω·cm.

3. A photosensor according to claim 1 or 2, characterized in that said photoconductive layer is 100 nm to 20 μm thick.

4. A photosensor according to claim 1 or 2, characterized in that an n-type oxide layer is interposed between said transparent conductive layer and said photoconductive layer.

5. A photosensor according to claim 4, characterized in that said n-type oxide layer is made of at least one member selected from the group consisting of cerium oxide, tungsten oxide, niobium oxide, germanium oxide and molybdenum oxide.

6. A photosensor according to claim 1 or 2, characterized in that said amorphous material containing hydrogen and silicon as indispensable constituent elements thereof is an amorphous material produced by the reactive sputtering in an atmosphere containing hydrogen.

7. A storage type photosensor according to claim 1 or 2, characterized in that a beam landing layer is disposed on said photoconductive layer.

8. A photosensor according to claim 1 or 2, characterized in that an n-type oxide layer is interposed between said transparent conductive layer and said photoconductive layer, and that a beam landing layer is disposed on said photoconductive layer.

9. A photosensor according to claim 1 characterized in that said photoconductive layer is constructed of a plurality of layers of photoconductive substances and that one of said plurality of layers of photoconductive substances comprises said region made of said amorphous material.

* * * * *